US006131196A

United States Patent [19]

Vallion

[11] Patent Number: 6,131,196

[45] Date of Patent: Oct. 17, 2000

[54] AIR CAPSULE CUSHION PADDING MEMBER FOR PROTECTIVE JOINT AND SAFETY PADS

[76] Inventor: Nina Vallion, 0205 SW. Montgomery, Portland, Oreg. 97201

[21] Appl. No.: 09/356,081

[22] Filed: Jul. 16, 1999

Related U.S. Application Data

[60] Provisional application No. 60/101,540, Sep. 23, 1998.

[51] Int. Cl.[7] ..... A41D 13/00

[52] U.S. Cl. ..... 2/24; 2/455; 2/267

[58] Field of Search ..... 2/24, 22, 16, 455, 2/247, 267, 911, 410, 413, 414, DIG. 3, DIG. 10; 128/878, 881, 882; 602/23, 26

[56] References Cited

U.S. PATENT DOCUMENTS

| | | | |
|---|---|---|---|
| 871,760 | 11/1907 | Long | 2/24 |
| 1,055,040 | 3/1913 | Herron et al. | 2/24 |
| 1,090,446 | 3/1914 | Boynton | 2/24 |
| 2,093,888 | 9/1937 | Holtje | 2/24 |
| 3,994,021 | 11/1976 | Villari et al. | 2/413 |
| 4,370,754 | 2/1983 | Donzis | 2/16 |
| 5,263,203 | 11/1993 | Kraemer et al. | 2/413 |
| 5,274,846 | 1/1994 | Kolsky | 2/16 |
| 5,524,292 | 6/1996 | Hargens | 2/24 |
| 5,551,084 | 9/1996 | Freese | 2/23 |

*Primary Examiner*—John J. Calvert
*Assistant Examiner*—Tejash Patel
*Attorney, Agent, or Firm*—Olson and Olson

[57] ABSTRACT

A hard shell safety knee pad is shown as having a cushion padding member formed of a plurality of layers of bubble cushioning material retained together against separation whereby to more comfortably distribute and support a wearer's weight and more effectively and comfortably cushion against the abrupt forces of a sudden and strong impact to the safety pad.

2 Claims, 1 Drawing Sheet

AIR CAPSULE CUSHION PADDING MEMBER FOR PROTECTIVE JOINT AND SAFETY PADS

This application claims the benefit under 35 U.S.C. 119 (e) of prior United States Provisional application Serial No. 60/101,540, filed Sep. 23, 1998.

BACKGROUND OF THE INVENTION

This invention relates to protective joint and body pads such as those worn during sports and other activities, and more particularly to an improved padding construction for virtually any such body and joint pads, the novel padding construction and arrangement in a preferred form of the invention utilizing multiple layers of bubble cushioning material sandwiched together in particular, desired arrangement to form an improved padding member configured to supplement or more preferably entirely replace the heretofore typical padding arrangement used in protective and safety pads currently available in the marketplace.

As is well known in the industry, a wide variety of different protective safety pads of a multitude of various different descriptions have been provided for athletes, recreational enthusiasts, construction workers and other users such as household workers and gardners, for a wide variety of purposes and uses. Generally these protective pads fall into two basic catagories: A first type having a soft, fabric outer covering, and a second type having a hard shell outer cover. Examples of different safety pad arrangements to which this invention applies include, but are not limited to, soft cover types of body and joint pads such as knee pads, elbow pads, thigh, hip, forearm, shin and tailbone pads used in such sports as football, volley ball, soccer, etc.; wrestling head gear; gardening and light duty knee pads to mention but a few. Examples of hard shell safety pads are also well known to virtually everyone, and include football and hockey shoulder pad assemblies; soccer, baseball and hockey shin and forearm pads; hard shell knee and elbow pads as used by roller bladers, skateboarders, construction workers, flooring installers, etc. Additionally, hard shell protective safety pads are also provided in the well-recognized form of helmets and hard hats configured for various well known purposes such as helmets for motorcycle and bicycle riding, roller blading, skateboarding, baseball, football and hockey, as well as a variety of construction hard hat arrangements, all being but a few examples of the wide variety of protective body pad gear in wide use for specialized purposes.

While various different padding and padding arrangements have been provided heretofore, and extensive study has gone into the development of the padding for these pads, it is substantially universal that the focus of the padding constructions of the prior art has been limited to cushioning arrangements directed to attempting to lessen impact conditions and their potential for injury, with little concern to user comfort and alternative impact-absorbing arrangements. Invariably the cushioning padding utilized in protective and safety padding is dense foam, felt, cotton, gel or complex and expensive inflatable bladder arrangements which all provide various degrees of protection against the impact of a blow. Unfortunately however they do little, if anything, in adequately diffusing the forces of such impact more broadly over the surface area of the user's body covered by and protected by the safety pad. The result is that, while the safety pads of the prior art do protect somewhat against serious impact, they do little to reduce the pain of such impact. Indeed, even in non impact situations, the cushioning is largely inadequate for comfort in constant pressure situations as, for example, in use by flooring installers who must constantly kneel throughout their work days. As all are well familiar with, the dense foam and other cushioning arrangements of knee pads of today's art create very painful pressure points on the kneeling areas of the legs which over time make kneeling with knee pads nearly as uncomfortable as if the user were kneeling directly on the hard floor surface he is working on.

It is therefore believed that it is readily apparent that a need exists in the marketplace for a new padding arrangement which is arranged to be more protective in heavy impact situations that current cushioning materials provide and also configured for comfort and for elimination of pressure points in use.

SUMMARY OF THE INVENTION

In its basic concept this invention provides a cushion padding member for protective and safety body pads and the like, the novel cushion padding member formed of gas-filled bubble cushioning material retained together as a substantially unitary member arranged and dimensioned for positioning in a selected protective or safety pad, either in substitution of or supplementary to other padding of a particular protective or safety pad member.

It is by virtue of the foregoing basic concept that the principal objective of this invention is achieved; namely, the provision of a cushion pad member for protective and safety body pads that provides enhanced cushioning against sudden impact, disburses and distributes cushioning over the entire surface area of the body underlying the protective pad member whereby to eliminate and prevent undesirable pressure points thereon, and provides for heretofore unprecedented increased comfort for the wearer under both impact and prolonged wearing conditions.

Another object and advantage of this invention is the provision of a cushion padding member of the class described which is very light in weight; will not absorb liquid and perspiration; is easily cleanable, and is easily removable for cleaning or laundering of the protective, safety pad member.

Another object and advantage of this invention is the provision of a cushion padding member of the class described which may be formed in virtually any desired configuration and shape for use in virtually any of a multitude of different safety pad members of different types and descriptions.

Yet another object and advantage of this invention is the provision of a cushion padding member of the class described wherein, in one preferred form of the invention, at least one of a plurality of layers of sheet-type bubble cushioning material has a preselected, lower burst strength than other layers, whereby to permit bursting of individual bubbles under a threshold impact for enhanced injury protection under extreme conditions as will become clear.

A still further object and advantage of this invention is the provision of a cushion padding member of the class described which is of simplified construction for economical manufacture and sale.

The foregoing and other objects and advantages of this invention will appear from the following detailed description, taken in connection with the accompanying detailed description of a preferred embodiment.

DESCRIPTION OF THE PREFERRED EMBODIMENT

As discussed previously, protective and safety pads are provided in a great many different types and configurations for virtually all different areas of a user's body, ranging from hard and soft knee and elbow pads to shoulder pads and shin guards; from wrestling head gear to full helmets and hard hats; to pad protection for virtually every body part for virtually any specialized activity and sport. Therefore it is to be understood that for simplicity of description herein, the term "safety pad member" shall be used throughout to designate generally any and all type and configuration of protective and safety pad member and not merely the exemplary knee pad member shown herein for purposes of illustration.

Also, reference will be made herein to bubble cushioning material in reference to the material used in the construction of the cushion padding member of this invention. Two different types of bubble cushioning material are contemplated for two different forms of the invention being disclosed herein.

The bubble cushioning material used in a first, preferred form of the invention is of a general type more commonly recognized by the public as BUBBLE WRAP, a widely used protective packaging wrapping material found commonly in the mailing, shipping and moving industries to protect packaged fragile and breakable items during transport. As is known, BUBBLE WRAP comprises a sheet of material formed of a pair of laminated layers of plastic sheeting formed with a multiplicity of sealed, gas filled capsules or bubbles (at normal atmospheric pressure) projecting from one side surface of the sheet. The filling of these sealed bubble capsules at normal atmospheric pressure gives the bubbles their recognized appearance of being rather limp, and only "partially filled" with air, providing their known characteristic of being highly deformable and compressible prior to the build up of internal air pressure. This material is provided with various different specifications, bubble sizes and burst strength tolerances as may be desired by the purchaser for various packaging means and requirements for the materials being wrapped and packaged.

Figure 1:
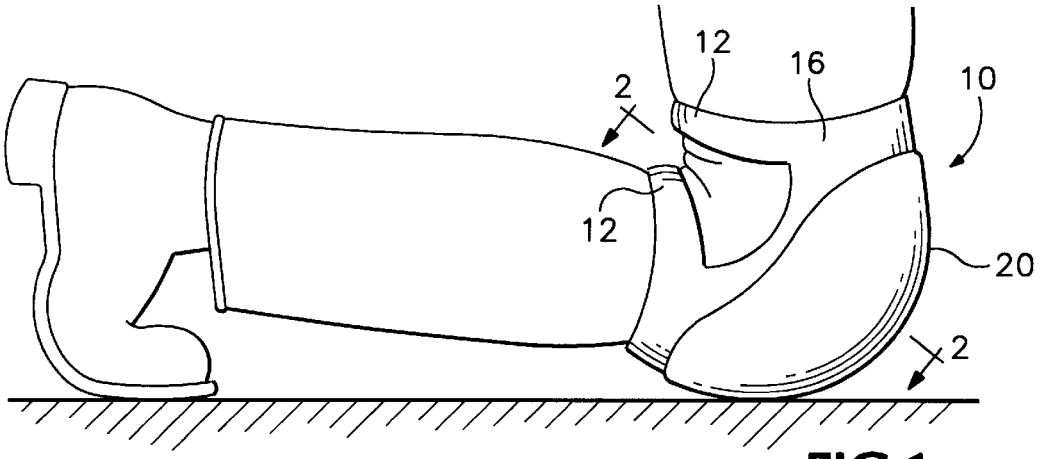
FIG. 1 is a fragmentary side view of a hard shell knee pad shown in place on a wearer's leg, the particular type of knee pad illustrated being of the type commonly used by workers in the construction and floor installing industries.

With the foregoing in mind, a safety pad member 10, embodied herein as a knee pad, includes a body-engaging, securing means (illustrated in this embodiment as leg encircling strap members 12) for removably attaching the safety pad member to a user's body in proper working condition as seen in FIG. 1. As seen best in FIG. 2, fabric extends from the leg strap 12 to form an inner fabric cover 14 and an outer fabric cover 16 arranged to encircle the knee area to be protected, forming between them a cushion padding-receiving pocket 18. The inner fabric cover 14 may as illustrated include an opening flap arrangement 14' whereby a cushion padding member may be installed into or removed from the pocket 18 for cleaning or laundering of the safety pad member. In a soft knee pad construction, the foregoing represents an essentially complete soft knee pad member construction. The embodiment illustrated shows a hard shell type knee pad wherein a rigid, hard shell cover member 20 is anchored to the outer covering 16 for extra protection against shock and impact, as is desirable for activities such as roller blading and skateboarding where injurious falls are more likely.

Figure 2:
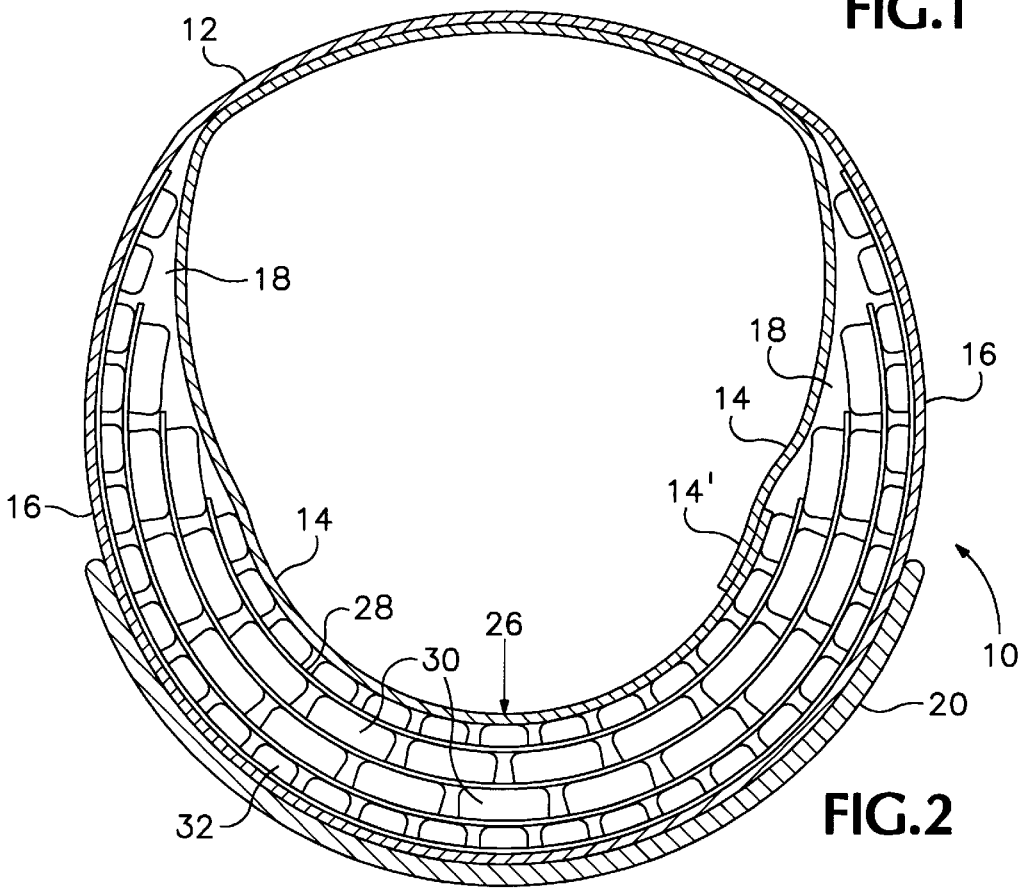
FIG. 2 is a sectional view through the center of the knee pad of FIG. 1 taken along the line 2—2 in FIG. 1.
Figure 3:
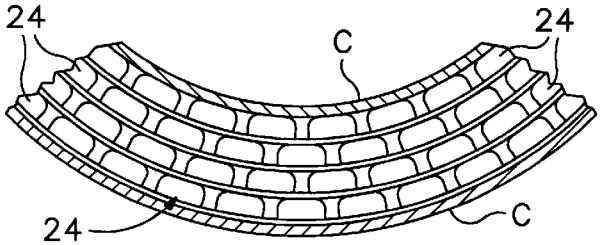
FIG. 3 is a fragmentary sectional view of an alternative padding configuration unique to this invention.

A first, preferred form of the novel cushion padding member of this invention is seen in two different illustrative versions in FIGS. 2 and 3 of the drawings. As will be understood, the cushion padding member of this form of the invention comprises at least two layers of bubble cushioning material sandwiched together into a unit that is sized and configured according to the particular safety pad member's requirements with respect to the surface area of the body part being protected. Although a single layer of bubble cushion material may be used to supplement a conventional foam or other padding of a safety pad to improve comfort of use in a few limited circumstances, most forms of the intention used to supplement conventional safety pad cushioning material will require at least two layers of bubble cushion material. However, most safety pads utilizing the cushion padding construction of this invention as sole padding will require a construction having three or more individual layers of bubble cushioning material as will herein be described.

Also important to the unique cushion padding construction of this invention is the requirement that means must be provided for confining or retaining the sealed air capsules (or bubbles) and a mutually-interacting, working relationship with each other, as well as being maintained as a complete unit in proper position on the safety pad member itself. To this end, as previously mentioned, in this first, preferred general form of the air capsule cushion padding member of this invention the bubble cushioning material used herein comprises sheet type material, and therefore the individual bubble-mounting layers of the padding member are provided means for maintaining the layers together in their proper sandwiched condition. This means for retaining the layers may be of any type suitable for the purpose such as by bonding the layers together as by chemical, heat or sonic bonding, or by providing an enclosing, confining cover member C (FIG. 3) of suitable sheet material such as plastic, vinyl or fabric to contain the individual layers of the cushion padding member together as a single, covered insert member. Further, in pad configurations such as the knee pad arrangement shown in FIG. 2, it may be desirable that the layerings of bubble cushion material be tapered at their end portions to permit cushioning of the side of the knee to a lesser degree since there is only remote likelihood of impact injury such as would be experienced on the front of the knee. This tapering of the cushion padding of course reduces the bulkiness of the finished knee pad member.

As is apparent from comparing FIG. 2 and FIG. 3, this invention also contemplates the provision of a cushion padding member having layers of bubble cushioning material that have different selected characteristics than are the characteristics of the bubble cushioning material of other layers in the sandwich. FIG. 3 illustrates a cushion padding member 22 embodying features of this invention wherein the four layer construct comprises bubble cushioning material having four layerings 24 of bubble cushioning material, each layer having the same structural characteristics of manufacture.

Cushion padding member 26 also comprises four layerings of bubble cushion material, a first, inner layer 28; a pair of middle layers 30; and an outer layer 32. As will be apparent, the inner layer 28 and the outer layer 32 in this example utilize a small bubble configuration while the middle layers 30 utilize a different, larger bubble configuration which may be advantageous in enhancing cushioning under shock by providing a greater surface area of deformably-confined air.

Also, by using bubble cushion material having a lower, predetermined, selected burst strength in one or more of the middle layers 30, (and a higher burst strength rating in the inner and outer layers 28, 32), a very advantageous result may be obtained in the cushioning function of the padding under high impact conditions. For example, in a hard fall, where the user's knee might impact upon the ground with unusually strong force such that an injury may well occur, in the first instant of impact the sandwiched layers of the cushion padding member will begin to compress. If one of the middle bubble cushion material layers 30 comprises a high impact "sacrificial" layer of material having a preselected lower burst strength for its bubbles, when overall pressure on one of the bubbles of that layer is reached, the bubble will burst and quickly deflate under pressure, providing a second, high impact cushioning effect. Virtually concurrently with the deflation of the burst bubble, the surrounding bubbles of all layers will naturally re-configure themselves in view of the newly voided space of the burst bubble, providing yet a third level of cushioning during the event. If additional sacrificial bubbles burst, the immediate re-shifting and re-accommodating of the confined air in the surrounding sealed air bubbles repeats, as is clearly apparent given the nature of fluid mechanics.

Clearly, the present invention offers great potential in the cushioning of a user's body against sudden and severe impact. Of course, once bubbles in the cushion padding member have burst, the padding insert would then be replaced with a new one for future use.

The cushion padding member of this invention also provides exemplary cushioning characteristics under ongoing, constant pressure situations as, for example, with flooring installers who spend great amounts of their work days on their knees. With FIG. 1 in mind, FIG. 2 should be viewed with the idea Qf a wearer's knee contained within the confines of the leg strap 12 and inner lining 14 and the wearer's weight bearing down on the knee pad assembly. As will be apparent to those skilled in the art, the bubbles of the first, inner layer 28 of bubble cushioning material will naturally conform themselves to the overall contour of the surface area of the leg, effectively cradling the contacted surface area of the knee in a substantial "form fit" arrangement that eliminates the possibility of any pressure points. The bubbles of the first layer 28, each under different and varying degrees of pressure, bear against the bubbles of the next adjacent layer 30 which deflect and deform to accommodate the pressure applied individually against them, transmitting pressure radially-outward to the next layer and the next in turn. As will be apparent, pressure is transmitted substantially three dimensionally to adjacent, surrounding individual bubbles of the sandwich, effectively resulting in a situation in which the wearer's weight is borne substantially evenly over the entire surface contact area of the inner layer 28 and there effectively transmitted outwardly in all directions through the various layers. Unlike foam padding of the prior art where the knee is supported on a substantially unyielding, dense material, the cushion padding member of this invention provides a substantially fluid, "pillow-like" form-fit support of the knee surface area that constantly changes to accommodate the leg as it moves about and changes position as the user moves about while kneeling on the safety pad. Again, the result is an extremely comfortable cushioning that by virtue of its fluid support of the body part, completely avoids pressure points and permits extended wear with full comfort.

Figure 4:
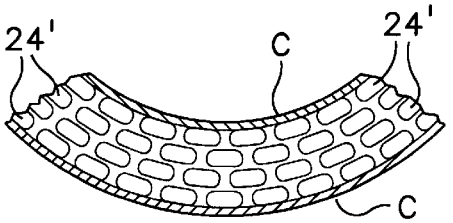
FIG. 4 is a fragmentary sectional view, on a reduced scale, similar to FIG. 3 showing a second general form of the padding construction of this invention utilizing a different form of the bubble cushioning material of FIGS. 2 and 3.

FIG. 4 of the drawings illustrates a second, alternative form of the unique air capsule cushion padding member of this invention wherein the bubble cushioning material comprises the same general type of sealed air capsules or bubbles as described earlier but in the form of separate, individual sealed-air bubbles 24' rather than the aforementioned bubble-mounting sheet form discussed previously. It is to be recognized in viewing FIG. 4 that for ease of illustration the individual bubbles 24' have been depicted in a consistent, uniform condition and orientation not unlike that seen in FIG. 3. In fact however, the individual capsules will actually be contained in the cover member C in a homogeneous mixture of randomly positioned, randomly oriented bubbles that would be difficult to depict and confusing to interpret in the sectional view of FIG. 4, and therefore the view is considered to be representative of a multiplicity of individual sealed air capsules contained within the space shown.

While it would be preferred that the low pressure sealed-air capsules be manufactured in individual form, the invention also contemplates the provision of individual bubbles by cutting out or punch-cutting out the individual bubbles from a sheet of the aforementioned type bubble cushioning material to provide for this particular, unique padding construction.

This embodiment of the invention utilizes the enclosing cover member C arrangement previously described as the retaining means for confining and retaining the bubbles in mutually-interacting, working relationship, as has already been described in connection with the embodiments of FIGS. 2 and 3. As will be understood, the cover member C is configured as necessary for the particular safety pad being served; its interior cavity filled with individual sealed-air capsules 24'; and finally sealed closed to form a single, closed, "pillow-like" insert member for insulation onto the safety pad member in a suitable, desired manner. Configured thusly, the individual sealed-air capsules contained within the enclosed insert member function, act and respond substantially identical in operation to the aforementioned sandwich layer construction described hereinbefore.

From the foregoing it will be apparent to those skilled in the art that various changes other than those already described may be made in the size, shape, type, number and arrangement of parts described hereinbefore without departing from the spirit of this invention and the scope of the appended claims.

Having thus described my invention and the manners in which it may be arranged and used, I claim:

1. A sealed-air safety pad configured for releasable attachment to a wearer's body for protection and cushioning of a selected portion of the wearer's body against constant pressure, impact and other outside contacts associated with various different activities, the safety pad consisting essentially of:

a) a body-engaging fabric cover member configured to overlie and cover a sealed portion of a wearer's body, said fabric cover member having a first, outer fabric layer and a second, inner, body-contacting fabric layer, the layers secured together to form a pocket member therebetween, said pocket member containing and confining only bubble cushioning material providing a multiplicity of sealed-air capsules each comprising a flexible envelope of substantially gas-impervious material containing a selected gas at low, substantially non-atmospheric pressure, and b) securing means on the fabric cover member for releasably securing the fabric cover member to a wearer's body with said bubble cushioning material-containing pocket member positioned over the part of a body to be protected.

2. The sealed-air safety pad of claim 1 including a hard shell cover member secured to said first, outer fabric layer overlying said bubble cushion material-containing pocket.

* * * * *